US011610554B2

(12) United States Patent
Kim et al.

(10) Patent No.: US 11,610,554 B2
(45) Date of Patent: Mar. 21, 2023

(54) LIGHT EMITTING DISPLAY APPARATUS

(71) Applicant: LG Display Co., Ltd., Seoul (KR)

(72) Inventors: MoungO Kim, Paju-si (KR); YuSok Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/495,247

(22) Filed: Oct. 6, 2021

(65) Prior Publication Data

US 2022/0199038 A1 Jun. 23, 2022

(30) Foreign Application Priority Data

Dec. 18, 2020 (KR) ..... 10-2020-0178095

(51) Int. Cl.
*G09G 3/3291* (2016.01)

(52) U.S. Cl.
CPC ... *G09G 3/3291* (2013.01); *G09G 2300/0876* (2013.01); *G09G 2310/0297* (2013.01)

(58) Field of Classification Search
CPC ..... G09G 3/3291; G09G 2300/0876; G09G 2310/0297
See application file for complete search history.

(56) References Cited

U.S. PATENT DOCUMENTS

2017/0154578 A1* 6/2017 In ..... G09G 3/3283
2018/0357964 A1 12/2018 Shin et al.
2019/0005889 A1* 1/2019 Kwon ..... G09G 3/30

FOREIGN PATENT DOCUMENTS

KR 10-2018-0115205 A 10/2018
KR 10-2018-0135321 A 12/2018
KR 10-2020-0046796 A 5/2020

* cited by examiner

*Primary Examiner* — Kenneth B Lee, Jr.
(74) *Attorney, Agent, or Firm* — Fenwick & West LLP

(57) ABSTRACT

A light emitting display apparatus, which turns on a first transistor included in a pixel driving unit and connected to a data line during a data period where a data voltage is supplied from a data driver to the data line, is provided. The light emitting display apparatus includes a light emitting display panel including a pixel including a first transistor connected to a gate line and a data line, a gate driver supplying a gate signal to the first transistor, a data driver supplying a data voltage to the data line, and a switching driver connecting the data line to the data driver or connecting a sensing line to the data driver, wherein the gate driver turns on and then turns off the first transistor during a data period where a data voltage is supplied from the data driver to the data line through the switching driver.

12 Claims, 10 Drawing Sheets

LIGHT EMITTING DISPLAY APPARATUS

CROSS-REFERENCE TO RELATED APPLICATIONS

This application claims the benefit of the Republic of Korea Patent Application No. 10-2020-0178095 filed on Dec. 18, 2020, which is hereby incorporated by reference in its entirety.

BACKGROUND

Field of the Disclosure

The present disclosure relates to a light emitting display apparatus.

Description of the Background

Light emitting display apparatuses are display apparatuses which emit light by using a light emitting device.

The intensity of light emitted from the light emitting device is changed by a degradation in a driving transistor included in a pixel driving unit which drives the light emitting device. In order to prevent such a problem, various compensation methods are used in the light emitting display apparatuses.

However, a data voltage supplied to a data line is shifted through coupling to a transistor which is included in a pixel driving unit and is turned on for executing a compensation method. Therefore, a normal data voltage is not supplied to the pixel driving unit.

A compensation operation of the light emitting display apparatuses is performed by widthwise line units of the light emitting display panel, and for example, is performed by units of pixels connected to a gate line, provided in a widthwise direction, of the light emitting display panel.

Therefore, in a case where an image is displayed by the light emitting display panel, when a normal data voltage is not supplied to the pixel driving unit by the compensation operation, a defect such as a widthwise belt may occur in a widthwise line of the light emitting display panel, and a color sense difference may occur in a displayed image.

SUMMARY

Accordingly, the present disclosure is directed to providing a light emitting display apparatus that substantially obviates one or more problems due to limitations and disadvantages of the related art.

An aspect of the present disclosure is directed to providing a light emitting display apparatus which turns on a transistor included in a pixel driving unit and connected to a data line during a data period where a data voltage is supplied from a data driver to the data line.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a light emitting display apparatus including a light emitting display panel including a pixel including a first transistor connected to a gate line and a data line, a gate driver supplying a gate signal to the first transistor, a data driver supplying a data voltage to the data line, and a switching driver connecting the data line to the data driver or connecting a sensing line, included in the pixel, to the data driver, wherein the gate driver turns on and then turns off the first transistor during a data period where a data voltage is supplied from the data driver to the data line through the switching driver.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of the disclosure, illustrate aspect(s) of the disclosure and together with the description serve to explain the principle of the disclosure.

In the drawings.

DETAILED DESCRIPTION

Figure 1:
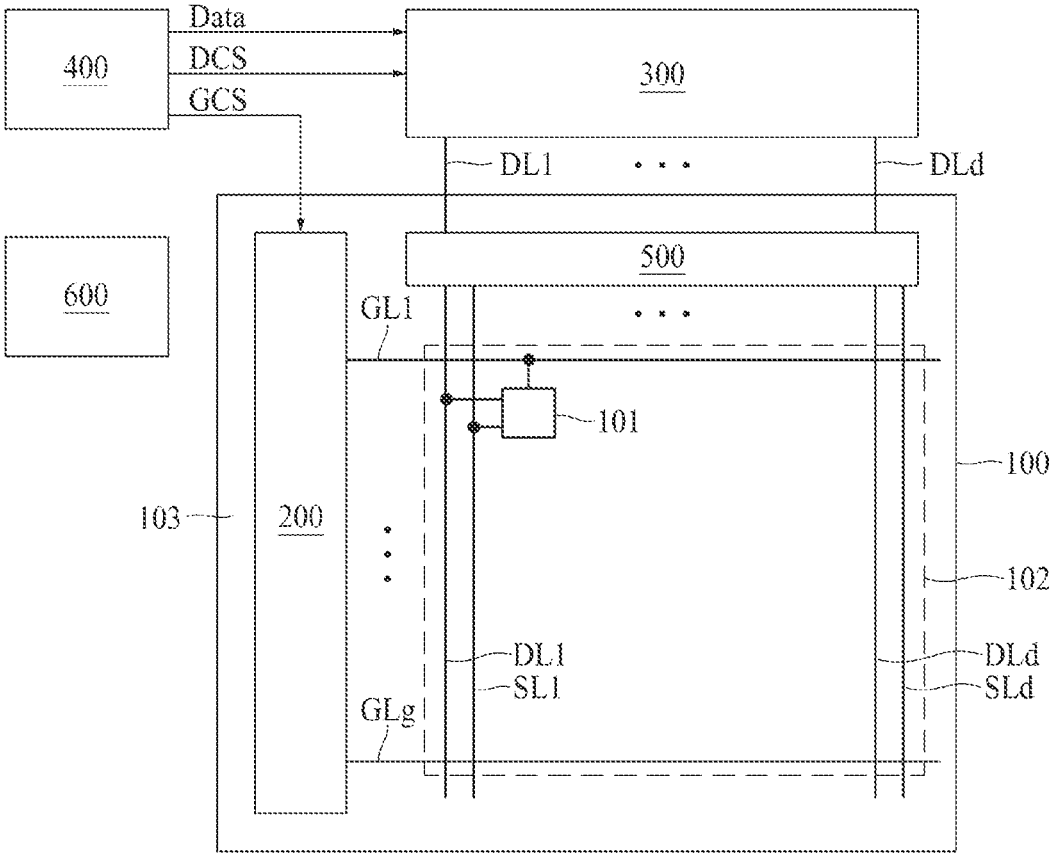
FIG. 1 is an exemplary diagram illustrating a configuration of a light emitting display apparatus according to one embodiment of the present disclosure.

Reference will now be made in detail to the exemplary aspects of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where "comprise", "have", and "include" described in the present specification are used, another part may be added unless "only-" is used. The terms of a singular form may include plural forms unless referred to the contrary.

In construing an element, the element is construed as including an error range although there is no explicit description.

In describing a position relationship, for example, when a position relation between two parts is described as "on~", "over~", "under~", and "next~", one or more other parts may be disposed between the two parts unless 'just' or 'direct' is used.

In describing a time relationship, for example, when the temporal order is described as "after~", "subsequent~", "next~", and "before~", a case which is not continuous may be included unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, aspects of the present disclosure will be described in detail with reference to the accompanying drawings.

Figure 2:
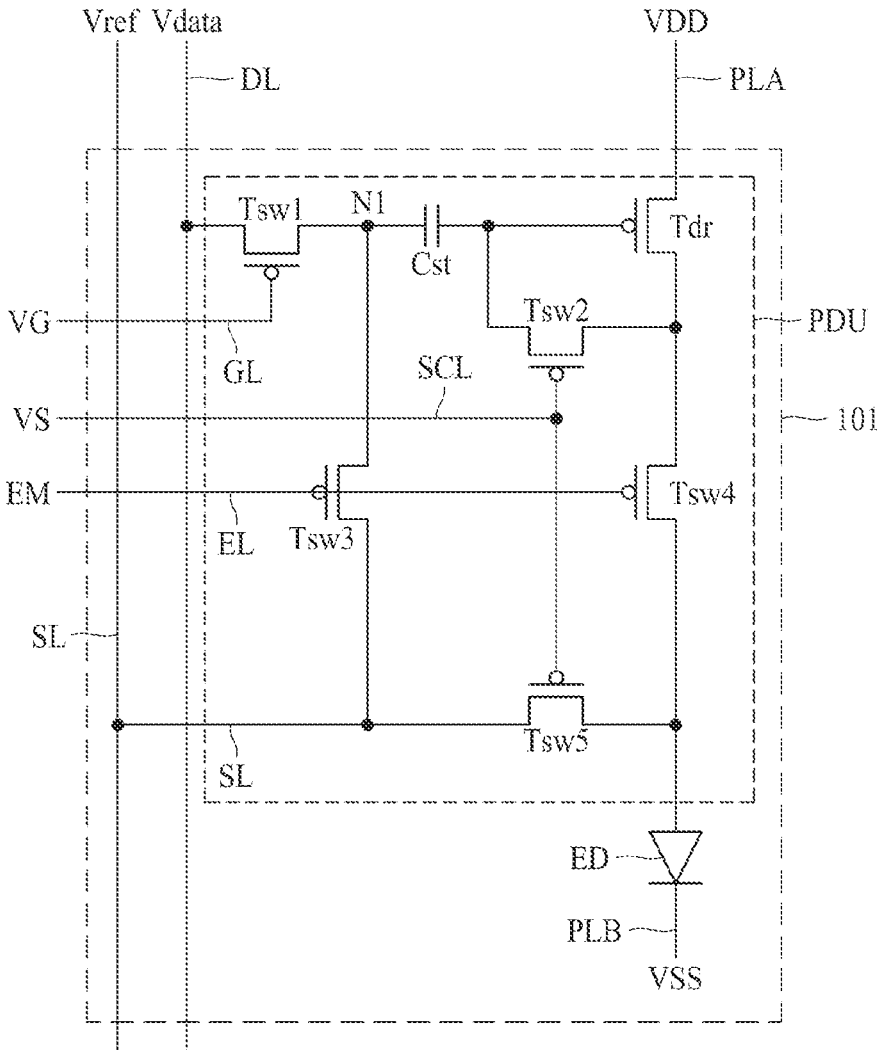
FIG. 2 is an exemplary diagram illustrating a structure of a pixel applied to a light emitting display apparatus according to one embodiment of the present disclosure.
Figure 3:
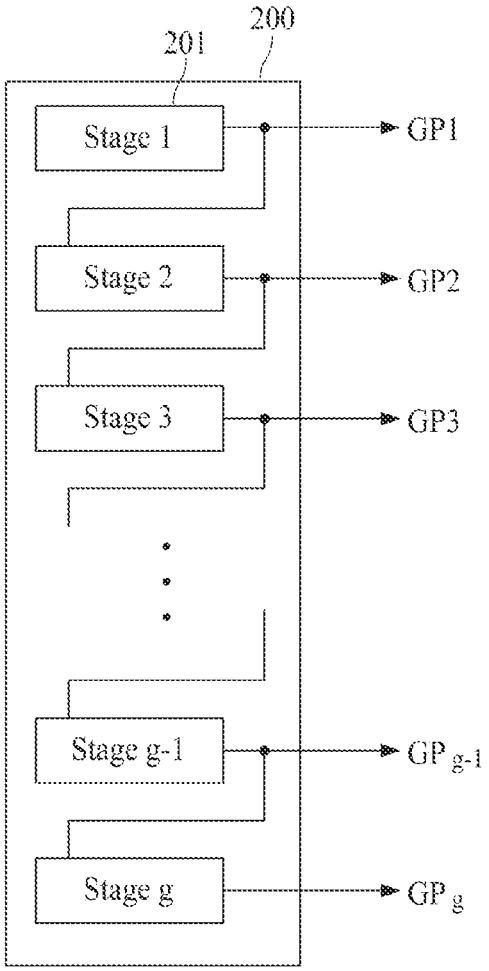
FIG. 3 is an exemplary diagram illustrating a configuration of a gate driver applied to a light emitting display apparatus according to one embodiment of the present disclosure.
Figure 4:
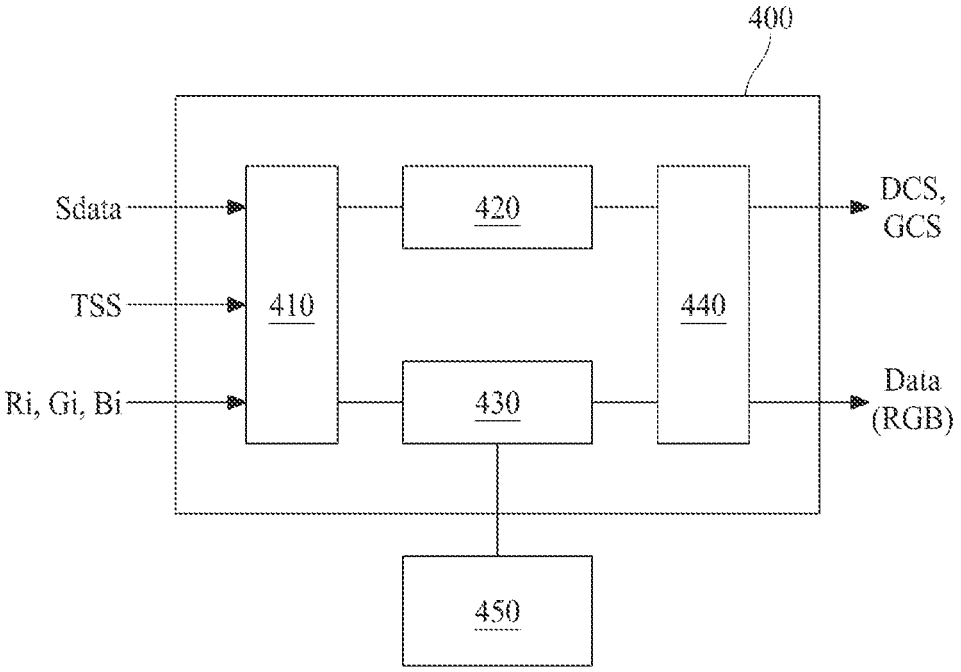
FIG. 4 is an exemplary diagram illustrating a configuration of a controller applied to a light emitting display apparatus according to one embodiment of the present disclosure.

FIG. 1 is an exemplary diagram illustrating a configuration of a light emitting display apparatus according to one embodiment of the present disclosure. FIG. 2 is an exemplary diagram illustrating a structure of a pixel applied to a light emitting display apparatus according to one embodiment of the present disclosure. FIG. 3 is an exemplary diagram illustrating a configuration of a gate driver applied to a light emitting display apparatus according to one embodiment of the present disclosure. FIG. 4 is an exemplary diagram illustrating a configuration of a controller applied to a light emitting display apparatus according to one embodiment of the present disclosure.

The light emitting display apparatus according to one embodiment of the present disclosure may configure various kinds of electronic devices. The electronic devices may include, for example, smartphones, tablet personal computers (PCs), televisions (TVs), and monitors.

The light emitting display apparatus according to one embodiment of the present disclosure, as illustrated in FIGS. 1 to 4, may include a light emitting display panel 100 which includes a pixel 101 including a first transistor Tsw1 connected to a gate line GL and a data line DL, a gate driver 200 which supplies a gate signal VG to the first transistor Tsw1, a data driver 300 which supplies a data voltage Vdata to a data line DL, a switching driver 500 which connects the data line DL to the data driver 300 or connects a sensing line SL, included in the pixel 101, to the data driver 300, and a controller 400. Particularly, the gate driver 200 may turn on or off the first transistor Tsw1 during a data period where the data voltage Vdata is supplied from the data driver 300 to the data line DL through the switching driver 500.

First, the light emitting display panel 100 may include a display area 102 and a non-display area 103. A plurality of gate lines GL1 to GLg, a plurality of data lines DL1 to DLd, a plurality of sensing lines SL1 to SLd, and a plurality of pixels 101 may be provided in the display area 102.

For example, as illustrated in FIG. 2, the pixel 101 included in the light emitting display panel 100 may include a light emitting device ED, first to fifth transistors Tsw1 to Tsw5, a capacitor Cst, and a driving transistor Tdr. That is, the pixel 101 may include a pixel driving unit PDU and a light emitting unit, and the pixel driving unit PDU may include the first to fifth transistors Tsw1 to Tsw5, the capacitor Cst, and the driving transistor Tdr. The light emitting unit may include the light emitting device ED.

The light emitting device ED may include one of an organic light emitting layer, an inorganic light emitting layer, and a quantum dot light emitting layer, or may include a stack or combination structure of an organic light emitting layer (or an inorganic light emitting layer) and a quantum dot light emitting layer.

Moreover, the light emitting device ED may emit light corresponding to one of various colors such as red, green, and blue, or may emit white light.

The first transistor Tsw1 configuring the pixel driving unit PDU may be turned on or off based on a gate signal VG supplied through the gate line GL, and when the first transistor Tsw1 is turned on, a data voltage Vdata supplied through the data line DL may be supplied to the driving transistor Tdr. A first voltage VDD may be supplied to the driving transistor Tdr and the light emitting device ED through a first voltage supply line PLA, and a second voltage VSS may be supplied to the light emitting device ED through a second voltage supply line PLB. The second transistor Tsw2 and the fifth transistor Tsw5 may be turned on or off based on a sensing control signal VS supplied through a sensing control line SCL. The third transistor Tsw3 and the fourth transistor Tsw4 may be turned on or off based on an emission signal EM supplied through an emission line EL. A reference voltage Vref may be supplied to the third transistor Tsw3 and the fifth transistor Tsw5 through the sensing line SL, and a sensing signal associated with a characteristic change of the light emitting device ED may be transferred to the sensing line SL through the fifth transistor Tsw5.

The pixel 101 applied to the present disclosure may be formed in a structure illustrated in FIG. 2, but the present disclosure is not limited thereto. Hereinafter, a light emitting display apparatus including a plurality of pixels 101 having a structure illustrated in FIG. 2 will be described as an example of the present disclosure. A structure of the pixel 101 illustrated in FIG. 2 will be described below in more detail.

Each of the pixels 101 may include the light emitting device ED and the pixel driving unit PDU.

The pixel driving unit PDU may include the first transistor Tsw1 which includes a first terminal connected to the data line DL and a gate connected to the gate line GL to which a gate signal VG is supplied, the driving transistor Tdr which includes a first terminal connected to the first voltage supply line PLA, the capacitor Cst which is connected between a second terminal of the first transistor Tsw1 and a gate of the driving transistor Tdr, the second transistor Tsw2 which includes a first terminal connected to the gate of the driving transistor Tdr, a second terminal connected to a second terminal of the driving transistor Tdr, and a gate connected to the sensing control line SCL, the third transistor Tsw3 which includes a first terminal connected to the second terminal of the first transistor Tsw1, a second terminal connected to the sensing line SL, and a gate connected to the emission line EL, the fourth transistor Tsw4 which includes a first terminal connected to the second terminal of the driving transistor Tdr, a second terminal connected to the first terminal of the light emitting device ED, and a gate connected to the emission line EL, and the fifth transistor Tsw5 which includes a first terminal connected to a first terminal of the light emitting device ED, a gate connected to the sensing control line SCL, and a second terminal connected to the sensing line SL.

In this case, in the light emitting display panel 100, a plurality of pixel areas including the pixels 101 may be formed, and a plurality of signal lines for supplying various signals to the pixel driving unit PDU included in the pixel 101 may be formed.

For example, in the light emitting display panel including the pixel 101 as illustrated in FIG. 2, the signal lines may include the gate line GL, the data line DL, the emission line EL, the sensing control line SCL, the first voltage supply line PLA, the second voltage supply line PLB, and the sensing line SL.

In this case, the gate line GL and the data line DL may be provided in different directions, and the sensing line SL may be provided in a first direction parallel to the data line DL and may be connected to the fifth transistors Tsw5 of pixels provided in the first direction.

For example, as illustrated in FIG. 1, in a case where the data line DL and the sensing line SL are provided in the first direction (i.e., a lengthwise direction) of the light emitting display panel 100, the gate line GL may be in the second direction (i.e., a widthwise direction) of the light emitting display panel 100. The first direction may be vertical to the second direction, but is not limited thereto and the first direction and the second direction may form various angles therebetween.

To provide an additional description, the light emitting display panel 100 may include the plurality of pixels 101, the plurality of gate lines GL1 to GLg which transfer a plurality of gate signals VG to the pixels 101, the plurality of data lines DL1 to DLd which transfer data voltages to the pixels 101, and the plurality of sensing lines SL1 to SLd which are connected to a plurality of light emitting devices ED respectively included in the pixels 101. In this case, each of the pixels 101 may include the light emitting device ED, the fifth transistor Tsw5 which includes the first terminal connected to the first terminal of the light emitting device ED, the gate connected to the sensing control line SCL, and the second terminal connected to the sensing line SL.

The data driver 300 may be provided on a chip-on film (COF) attached on the light emitting display panel 100 and may be connected to a main substrate including the controller 400. In this case, the COF may include a plurality of lines which electrically connect the controller 400, the data driver 300, and the light emitting display panel 100, and to this end, the lines may electrically connect the main substrate to a plurality of pads included in the light emitting display panel 100. The main substrate may be electrically connected to an external substrate with an external system mounted thereon.

The data driver 300 may be directly mounted on the light emitting display panel 100, and then, may be electrically connected to the main substrate.

However, the data driver 300 may be implemented as one integrated circuit (IC) along with the controller 400, and the IC may be provided on the COF or may be directly mounted on the light emitting display panel 100.

The data driver 300 may receive a sensing signal, associated with a characteristic change of the light emitting device ED included in the light emitting display panel 100, from the light emitting display panel 100 and may transfer the sensing signal to the controller 400.

The gate driver 200 may be configured as an IC and may be mounted in the non-display area 103, or may be directly embedded into the non-display area 103 by using a gate in panel (GIP) type. In a case which uses the GIP type, a plurality of transistors configuring the gate driver 200 may be provided in the non-display area 103 through the same process as transistors included in each of the pixels 101 of the display area 102.

When a gate pulse generated by the gate driver 200 is supplied to the gate of the first transistor Tsw1 included in the pixel 101, the first transistor Tsw1 may be turned on. When a gate-off signal is supplied to the first transistor Tsw1, the first transistor Tsw1 may be turned off. The gate signal VG supplied through the gate line GL may include the gate pulse and the gate-off signal.

The gate driver 200, as illustrated in FIG. 3, may include a plurality of stages 201 which supply a plurality of gate pulses GP1 to GPg to the gate lines GL1 to GLg connected to the pixels 101.

In this case, each of the stages 201 may generate the gate signal VG supplied to the gate lines GL1 to GLg, and moreover, as illustrated in FIG. 2, may further generate various signals (for example, a sensing control signal VS and an emission signal EM).

For example, each of the stages 201 may generate all of the gate signal VG, the sensing control signal VS, and the emission signal EM. The gate signal VG may be sequentially supplied to the gate lines GL1 to GLg, the sensing control signal VS may be sequentially supplied to the sensing control lines SCL, and the emission signal EM may be sequentially supplied to the emission lines EL.

However, the stages 201 for generating the gate signal VG, the sensing control signal VS, and the emission signal EM may be independently configured. That is, one stage 201 may generate at least one of the gate signal VG, the sensing control signal VS, and the emission signal EM.

That is, the gate signal VG, the sensing control signal VS, and the emission signal EM supplied to one pixel 101 may be generated by one stage 201, or may be generated by at least two stages 201.

Subsequently, a power supply 600 may generate voltages used to generate the gate signal VG, the sensing control signal VS, the emission signal EM, the data voltage Vdata, and the reference voltage Vref and may supply the generated voltages to the gate driver 200 and the data driver 300.

Referring to FIG. 4, the controller 400 may include a data aligner 430 which realigns pieces of video data Ri, Gi, and Bi transmitted from the external system by using a timing synchronization signal TSS transmitted from the external system to supply pieces of realigned image data Data to the data driver 300, a control signal generator 420 which generates a gate control signal GCS and a data control signal DCS by using the timing synchronization signal TSS, an input unit 410 which receives the timing synchronization signal TSS and the pieces of video data Ri, Gi, and Bi transmitted from the external system and transfers the timing synchronization signal TSS and the pieces of video data Ri, Gi, and Bi to the data aligner 430 and the control signal generator 420, and an output unit 440 which outputs, to the data driver 300 or the gate driver 200, the pieces of image data Data generated by the data aligner 430 and the control signals GCS and DCS generated by the control signal generator 420.

The controller 400 may perform a function of storing sensing data Sdata transferred from the data driver 300, and to this end, the controller 400 may include a storage unit 450. However, the storage unit 450 may be provided as an independent element in the light emitting display apparatus.

The control signal generator 420 may further generate a control signal (hereinafter simply referred to as a switching driver control signal) for controlling the switching driver 500.

The external system may perform a function of driving the controller 400 and an electronic device. That is, when the electronic device is a smartphone, the external system may receive various sound information, image information, and letter information over a wireless communication network and may transfer the received image information to the controller 400. The image information may include the pieces of input video information Ri, Gi, and Bi.

The switching driver 500 may connect the data line DL or the sensing line SL to the data driver 300 on the basis of a switching driver control signal transferred from the controller 400.

The switching driver 500 may be included in the data driver 300, or may be provided independently from the data driver 300.

When the switching driver 500 is an independent element, as illustrated in FIG. 1, the switching driver 500 may be provided in the non-display area 103, and particularly, may be provided in a region where the data driver 300 is provided. In the following description, a light emitting display apparatus including the switching driver 500 which is independently provided will be described as an example of the present disclosure.

A detailed configuration and function of the switching driver 500 will be described below with reference to FIG. 5.

Figure 5:
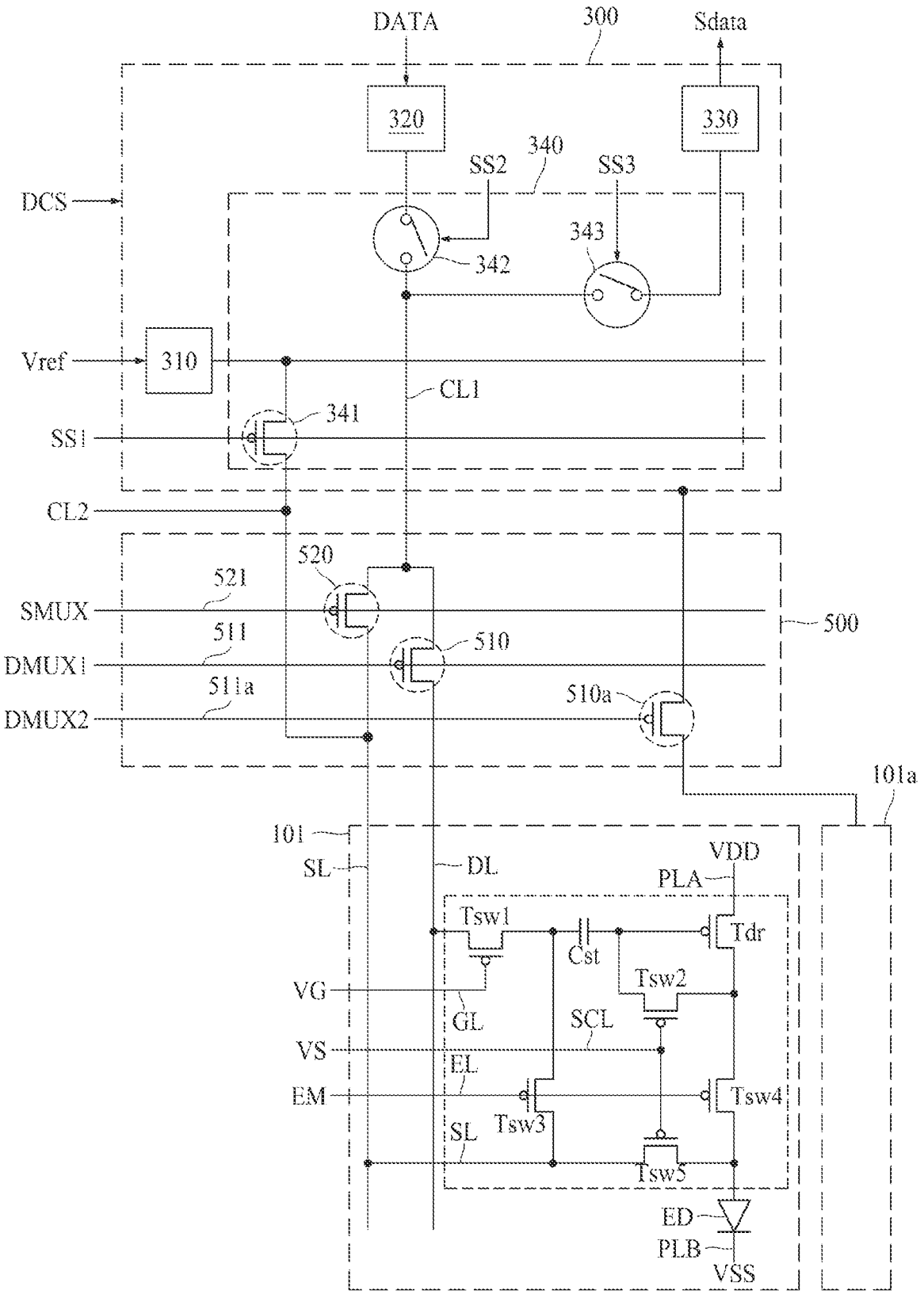
FIG. 5 is an exemplary diagram illustrating a structure of each of a data driver and a switching driver applied to a light emitting display apparatus according to one embodiment of the present disclosure.

FIG. 5 is an exemplary diagram illustrating a structure of each of a data driver and a switching driver applied to a light emitting display apparatus according to one embodiment of the present disclosure.

In a display period where internal compensation is performed on the driving transistor Tdr and an image is displayed, the data driver 300 may supply a data voltage to the data line DL included in the light emitting display panel 100. Also, when the light emitting display apparatus is turned on or off, the data driver 300 may perform a function of sensing a characteristic change of the light emitting device ED. In the following description, when the light emitting display apparatus is turned on or off, a period where a characteristic of the light emitting device is sensed may be referred to as a light emitting device sensing period.

That is, in the display period, the data driver 300 may supply the pixel driving unit PDU with the data voltage Vdata for displaying an image, on the basis of a timing for internal compensation.

Moreover, in the light emitting device sensing period, the data driver 300 may convert a sensing signal, transferred through the sensing line SL included in the light emitting display panel 100, into sensing data Sdata, and the sensing data Sdata may be transferred to the controller 400. Also, a switching driver 500 may connect the data line DL or the sensing line SL to the data driver 300 on the basis of the switching driver control signal transferred from the controller 400.

In order to perform the above-described function, the data driver 300 and the switching driver 500 may be configured as illustrated in FIG. 5.

First, the data driver 300 may include a data voltage generator 320 which generates data voltage Vdata which is to be transferred to the data line DL, a reference voltage transferor 310 which transfers a reference voltage Vref to the sensing line SL, a converter 330 which converts the sensing signal, transferred through the sensing line SL, into the sensing data Sdata and outputs the sensing data Sdata to the controller 400, and a switching unit 340 which connects the switching driver 500 to one of the data voltage generator 320, the reference voltage transferor 310, and the converter 330.

The reference voltage transferor 310 may directly generate and output the reference voltage Vref by using power supplied from a power supply, or may output the reference voltage Vref supplied from the power supply. Therefore, the reference voltage transferor 310 and a first switch 341 connected to the reference voltage transferor 310 may be configured independently from the data driver 300. For example, the reference voltage transferor 310 and the first switch 341 may be included in the switching driver 500. Hereinafter, however, for convenience of description, the data driver 300 including the reference voltage transferor 310 and the first switch 341 will be described as an example of the present disclosure.

The data voltage generator 320 may convert digital image data DATA, transferred from the controller 400, into an analog data voltage Vdata and may output the analog data voltage Vdata. The data voltage generator 320 may be a data driver which is generally used for converting the image data DATA into the data voltage Vdata, and thus, a detailed description of the data voltage generator 320 is omitted.

The converter 330 may convert the sensing signal, transferred through the sensing line SL, into the sensing data Sdata and may output the sensing data Sdata to the controller 400. To this end, the converter 330 may include an analogto-digital converter (ADC) which converts an analog sensing signal into digital sensing data Sdata.

In order to accurately control an operation timing of each of the converter 330, the data voltage generator 320, and the reference voltage transferor 310, a switch may be included in each of the converter 330, the data voltage generator 320, and the reference voltage transferor 310, and a plurality of switches included in the converter 330, the data voltage generator 320, and the reference voltage transferor 310 may be controlled by the data control signal DCS transferred from the controller 400.

The data control signal DCS may include various control signals for controlling an operation timing of each of the reference voltage transferor 310, the data voltage generator 320, and the converter 330.

The switching unit 340 may connect the switching driver 500 to one of the reference voltage transferor 310, the data voltage generator 320, and the converter 330.

To this end, the switching unit 340 may be connected to the data voltage generator 320 and the converter 330 through a connection line CL1 and may be connected to the reference voltage transferor 310 through a sensing connection line CL2.

The switching driver 500 may be connected to one of the reference voltage transferor 310, the data voltage generator 320, and the converter 330 on the basis of a first switching control signal SS1, a second switching control signal SS2, and a third switching control signal SS3 transferred from the controller 400.

The first to third switching control signals SS1 to SS3 may be included in the data control signal DCS generated by the controller 400.

The switching unit 340 may include the first switch 341, a second switch 342, and a third switch 343.

The first switching control signal SS1 may control the first switch 341 connected between the reference voltage transferor 310 and the sensing connection line CL2, the second switching control signal SS2 may control the second switch 342 connected between the data voltage generator 320 and the connection line CL1, and the third switching control signal SS3 may control the third switch 343 connected between the converter 330 and the connection line CL1.

The first to third switches 341 to 343 may each include a transistor which is turned on or off by the first to third switching control signals SS1 to SS3.

Second, the switching driver 500 may include a first switching unit 510 which connects the data line DL to the data driver 300 and a MUX switching unit 520 which connects the sensing line SL to the data driver 300.

That is, the first switching unit 510 may be connected between the data line DL and the connection line CL1, and the MUX switching unit 520 may be connected between the sensing line SL and the connection line CL1. The sensing line SL may be connected to the first switch 341.

When the data line DL is connected to the connection line CL1 by the first switching unit 510, the sensing line SL is not connected to the connection line CL1 by the MUX switching unit 520.

The first switching unit 510, as illustrated in FIG. 5, may include a transistor which includes a first terminal connected to the connection line CL1, a second terminal connected to the data line DL, and a gate connected to a first signal line 511. A first control signal DMUX1 may be supplied to the first signal line 511. A second control signal DMUX2 supplied to a second signal line 511*a* may be supplied to a second switching unit 510*a*. The second switching unit 510*a* may be connected to another pixel 101*a* instead of a pixel 101 connected to the first switching unit 510. That is, the first switching unit 510 and the second switching unit 510*a* may be connected to different pixels 101 and 101*a*.

The MUX switching unit 520, as illustrated in FIG. 5, may include a transistor which includes a first terminal connected to the connection line CL1, a second terminal connected to the sensing line SL, and a gate connected to a MUX signal line 521. A MUX control signal SMUX may be supplied to the MUX signal line 521.

The switching driver control signal may include the first control signal DMUX1, the second control signal DMUX2, and the MUX control signal SMUX.

The switching driver control signal, as described above, may be generated by the control signal generator 420 of the controller 400.

In order to prevent or at least reduce the occurrence of static electricity, one side of the capacitor may be connected to the data line DL, and the other side of the capacitor may be connected to a line to which the second voltage VSS is supplied. Also, in order to prevent or at least reduce the occurrence of static electricity, the one side of the capacitor may be connected to the sensing line SL, and the other side of the capacitor may be connected to a line to which the second voltage VSS is supplied.

As described above, the light emitting display apparatus according to the present disclosure may display an image by using internal compensation in the display period, and moreover, may sense a characteristic of the light emitting device in the light emitting device sensing period.

According to the present disclosure, during a data period where the data voltage Vdata is supplied from the data driver 300 to the data line DL, the first transistor Tsw1 may be turned on. That is, a feature of the present disclosure may be executed in the display period.

Hereinafter, therefore, a feature of the present disclosure performed in the light emitting device sensing period will be briefly described, and features of the present disclosure performed in the display period will be described in detail with reference to FIGS. 1 to 7.

A method of sensing a characteristic of a light emitting device in the light emitting device sensing period will be briefly described below.

In a charging period of the sensing period, an electric charge may be charged into the first terminal of the light emitting device ED with a sensing driving voltage applied to the first terminal of the light emitting device ED through the sensing line SL and the fifth transistor Tsw5. That is, in the charging period, an electric charge may be charged into the light emitting device ED with the sensing driving voltage applied to the light emitting device ED through the sensing line SL.

In the sensing period of the light emitting device sensing period, electric charges charged into the light emitting device ED may be discharged. The converter 330 may measure the amount of discharged electric charges, convert a measured signal into the sensing data Sdata, and transfer the sensing data Sdata to the controller 400. The controller 400 may calculate the amount of characteristic change of the light emitting device ED by using the sensing data S data. Subsequently, when the display period starts, the controller 400 may supply input video data as image data by using the calculated amount of characteristic change of the light emitting device ED, or may vary a level of the first voltage VDD or the reference voltage Vref.

FIGS. 6A to 6D are exemplary diagrams for describing an internal compensation method applied to a light emitting display apparatus according to one embodiment of the present disclosure.

In a display period where an image is displayed, the light emitting display apparatus according to an aspect of the present disclosure may perform internal compensation. When the internal compensation is performed, a current supplied to the light emitting device ED may not be affected by a characteristic of a driving transistor Tdr (for example, a threshold voltage of the driving transistor Tdr).

That is, when the driving transistor Tdr is degraded, the threshold voltage of the driving transistor Tdr may vary, and thus, luminance corresponding to image data Data may not be accurately expressed. In order to prevent or at least reduce such a problem, various kinds of compensation methods may be performed, and an internal compensation method may be one of various kinds of compensation methods.

In the light emitting display apparatus which performs the internal compensation method, a level of a current supplied to the light emitting device ED may vary based on the image data Data regardless of a variation of the threshold voltage of the driving transistor Tdr. Accordingly, luminance corresponding to the image data Data may be accurately expressed.

While the internal compensation method is being performed, when a first transistor Tsw1 is turned off, a data voltage Vdata supplied to a data line DL may not be supplied to the driving transistor Tdr, and when the first transistor Tsw1 is turned on, the data voltage Vdata supplied to the data line DL may be supplied to the driving transistor Tdr.

In this case, at a time at which the first transistor Tsw1 is turned on, the data voltage Vdata may vary through coupling to the first transistor Tsw1. When the data voltage Vdata varies through coupling to the first transistor Tsw1, the data voltage Vdata output from the data driver 300 may differ from a data voltage supplied to the driving transistor Tdr, and thus, a widthwise-belt defect and a color sense difference may occur in a light emitting display panel. The present disclosure may be for preventing or at least reducing the occurrence of a coupling phenomenon.

A feature of the present disclosure, as described above, may be relevant to a process of performing internal compensation.

Hereinafter, therefore, an internal compensation method applied to the present disclosure will be described with reference to FIGS. 6A to 6D.

Figure 6A:
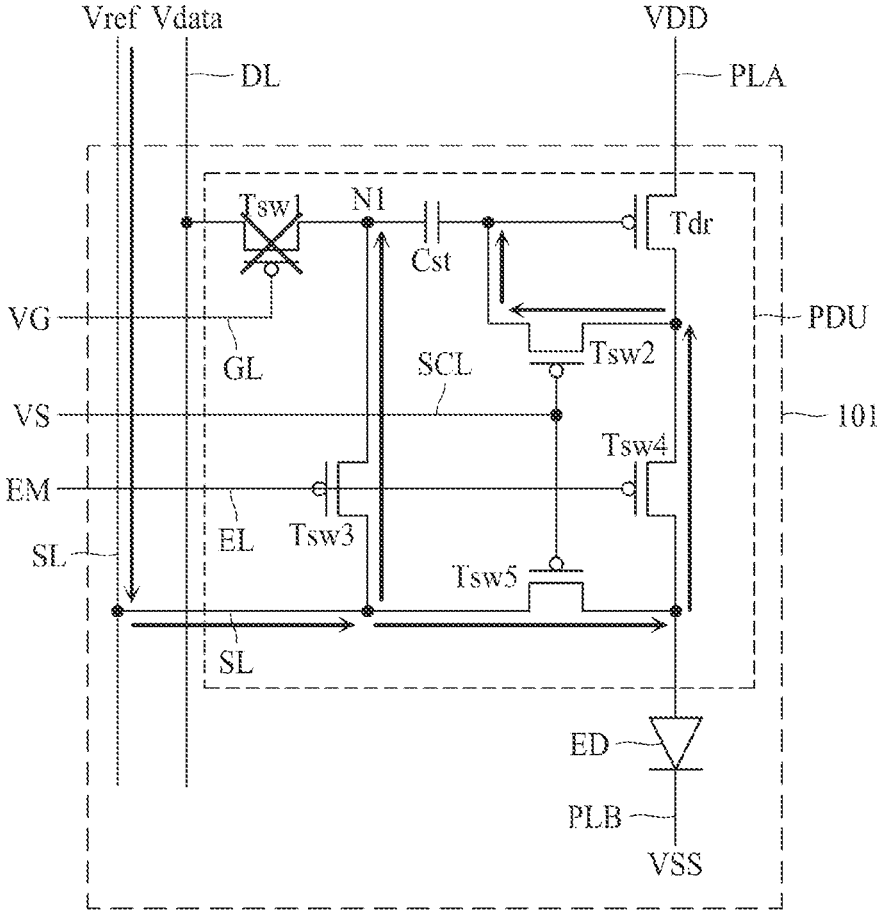
FIGS. 6A to 6D are exemplary diagrams for describing an internal compensation method applied to a light emitting display apparatus according to one embodiment of the present disclosure.

First, when an initialization period starts, as illustrated in FIG. 6A, a first transistor Tsw1 may be turned off, and second to fifth transistors Tsw2 to Tsw5 may be turned on.

In this case, because the first transistor Tsw1 is turned off, a data voltage Vdata supplied to a data line DL may not affect a first node N1.

A reference voltage Vref supplied to a sensing line SL through a first switching unit 341 may be supplied to the first node N1 through a third transistor Tsw3. Therefore, a voltage of the first node N1 (hereinafter simply referred to as a first node voltage) between the first transistor Tsw1 and a capacitor Cst may be the reference voltage Vref transferred through the sensing line SL and the third transistor Tsw3. That is, the first node N1 may be initialized by the reference voltage Vref.

A gate of the driving transistor Tdr may also be initialized by the reference voltage Vref supplied through a fifth transistor Tsw5, a fourth transistor Tsw4, and a second transistor Tsw2. Also, a first terminal of the light emitting device ED may be initialized by the reference voltage Vref transferred through the fifth transistor Tsw5.

Figure 6B:
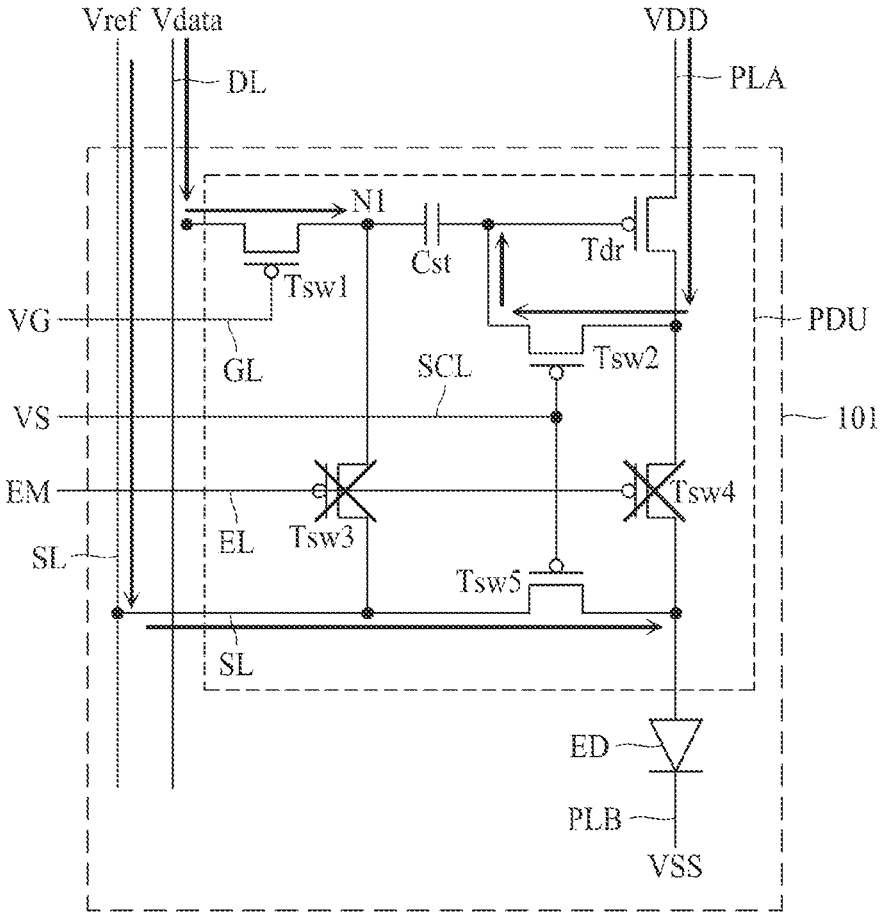

Subsequently, when a sampling period starts, as illustrated in FIG. 6B, the first transistor Tsw1, the second transistor Tsw2, the fifth transistor Tsw5, and the driving transistor Tdr may be turned on, and the third transistor Tsw3 and the fourth transistor Tsw4 may be turned off.

In this case, a data voltage Vdata supplied to the data line DL may be applied to the first node N1 through the turned-on first transistor Tsw1. Accordingly, the first node voltage may be the data voltage Vdata.

Moreover, a voltage at a gate of the driving transistor Tdr (hereinafter simply referred to as a gate voltage) may be a difference voltage (=VDD−|Vth|) between an absolute value of a threshold voltage Vth of the driving transistor Tdr and a first voltage VDD applied through the driving transistor Tdr.

Figure 6C:
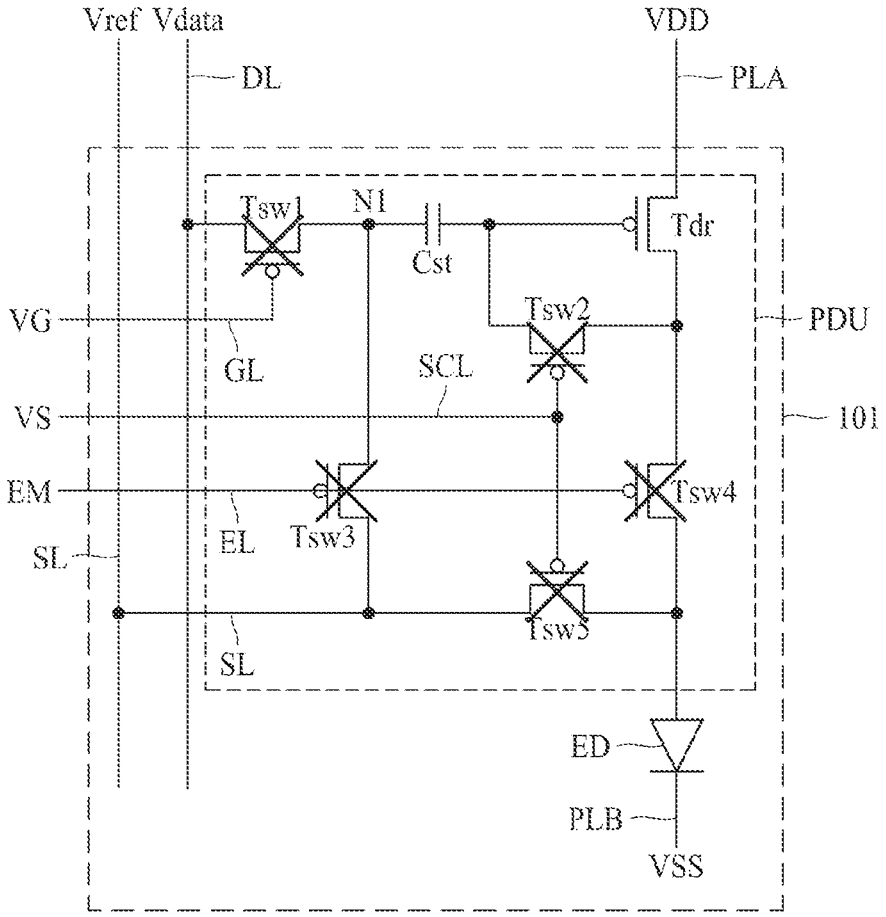

Subsequently, when a hold period starts, as illustrated in FIG. 6C, the first to fifth transistors Tsw1 to Tsw5 may be turned off.

In this case, the first node voltage and the gate voltage of the driving transistor may be maintained as the first node voltage and the gate voltage of the driving transistor in the sampling period.

That is, the gate voltage of the driving transistor Tdr may be maintained as the difference voltage (=VDD−|Vth|) between the absolute value of the threshold voltage Vth of the driving transistor Tdr and the first voltage VDD.

Figure 6D:
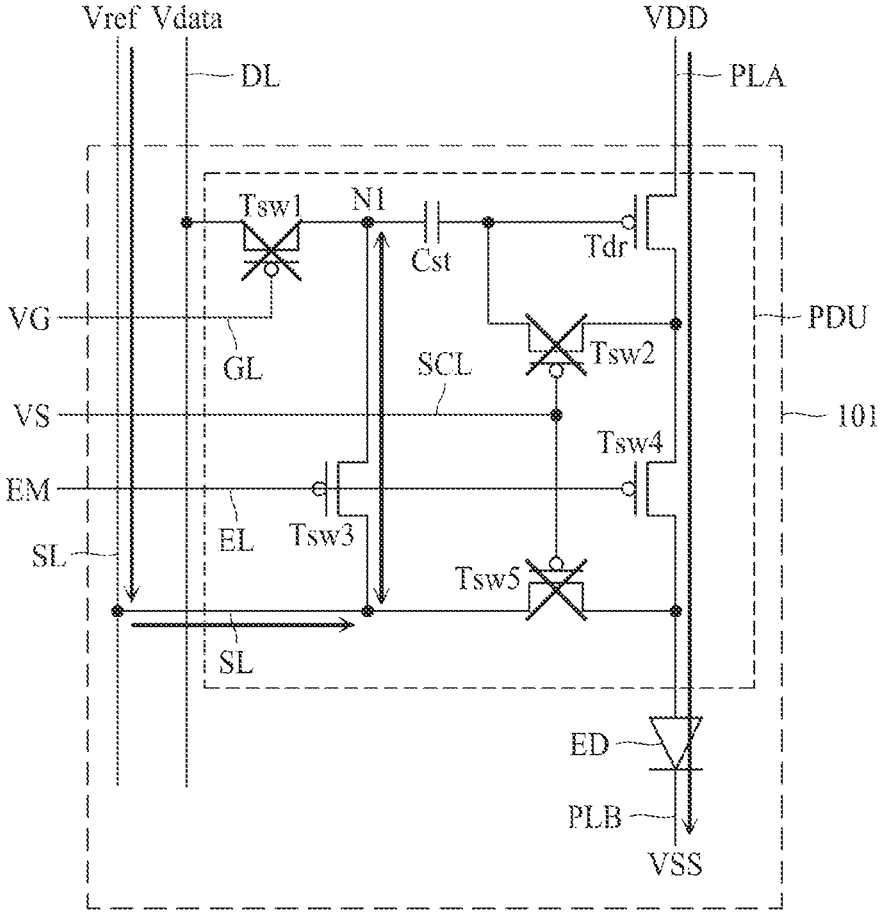

Finally, when an emission period starts, as illustrated in FIG. 6D, the third transistor Tsw3, the fourth transistor Tsw4, and the driving transistor may be turned on, and the first transistor Tsw1, the second transistor Tsw2, and the fifth transistor Tsw5 may be turned off.

Therefore, the light emitting device ED may emit light with a current supplied through the driving transistor Tdr and the fourth transistor Tsw4.

In this case, the reference voltage Vref supplied through the third transistor Tsw3 may be applied to the first node N1. Accordingly, the first node voltage may be the reference voltage Vref. That is, the first node voltage may be changed from the data voltage Vdata to the reference voltage Vref in the sampling period and the hold period.

Therefore, the gate voltage of the driving transistor Tdr may be a value obtained by subtracting a difference voltage (=Vdata−Vref) between the data voltage Vdata and the reference voltage Vref from the difference voltage (=VDD−|Vth|) between the absolute value of the threshold voltage Vth of the driving transistor Tdr and the first voltage VDD.

In the emission period, a level of a current flowing in the driving transistor Tdr may be proportional to the square of a difference voltage VGS between a source voltage and the gate voltage of the driving transistor Tdr and a difference voltage between the threshold voltage Vth of the driving transistor Tdr.

In the light emitting display apparatus according to the present disclosure, in the emission period, the gate voltage of the driving transistor Tdr may be a value obtained by subtracting the difference voltage (=Vdata−Vref) between the data voltage Vdata and the reference voltage Vref from the difference voltage (=VDD−|Vth|) between the absolute value of the threshold voltage Vth of the driving transistor Tdr and the first voltage VDD and the source voltage of the driving transistor Tdr may be the first voltage VDD, and thus, as expressed in the following Equation 1, a level of a current flowing in the driving transistor Tdr may be proportional to the square of a difference voltage between the data voltage Vdata and the reference voltage Vref.

$$I=k(V\text{data}-V\text{ref})^2 \quad \text{[Equation 1]}$$

That is, in the light emitting display apparatus according to the present disclosure using the internal compensation method, as expressed in Equation 1, a current I supplied to the light emitting device ED through the driving transistor Tdr may vary based on only the data voltage Vdata supplied through the data line DL and the reference voltage Vref supplied through a sensing line SL and may not vary based on the threshold voltage Vth of the driving transistor Tdr. In this case, k indicates a proportional constant determined by the electron mobility, parasitic capacitance, and channel capacity of the driving transistor Tdr.

Therefore, even when the threshold voltage of the driving transistor Tdr varies due to a degradation in the driving transistor Tdr, the luminance of light emitted from the light emitting device ED may vary based on only the data voltage Vdata. Accordingly, the light emitting display apparatus according to the present disclosure may continuously and stably operate.

Figure 7:
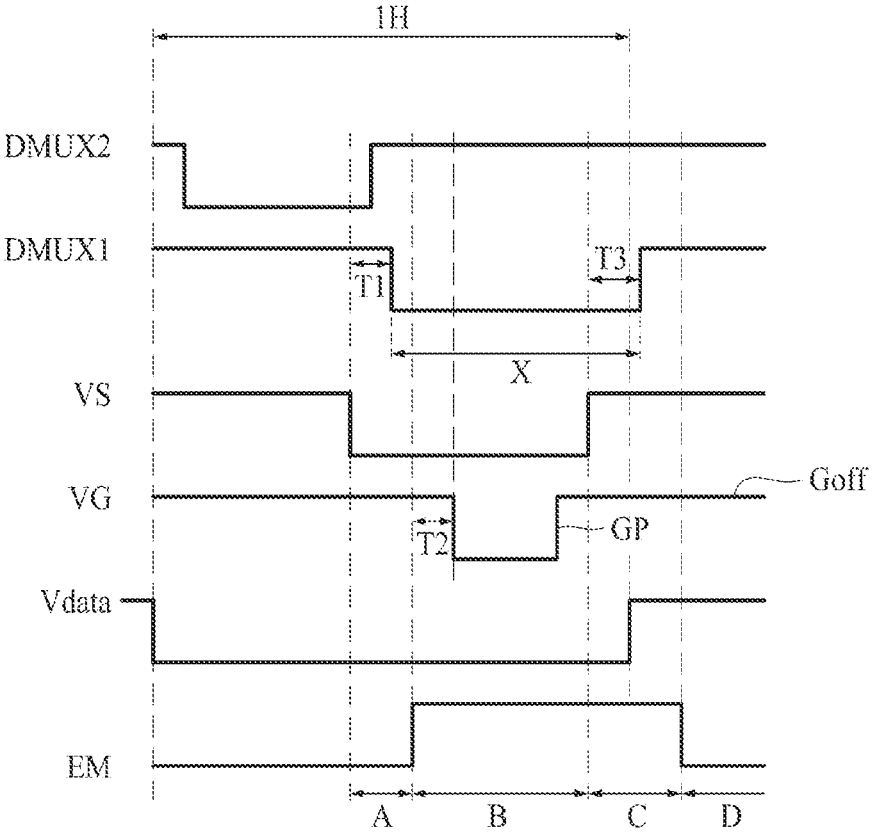
FIG. 7 is a waveform diagram showing a relationship between a first control signal and a gate signal applied to a light emitting display apparatus according to one embodiment of the present disclosure.

FIG. 7 is a waveform diagram showing a relationship between a first control signal and a gate signal applied to a light emitting display apparatus according to an aspect of the present disclosure.

A feature of the present disclosure, as described above, may be relevant to a process of performing internal compensation. The internal compensation method has been described above with reference to FIGS. 6A to 6D. Hereinafter, therefore, a feature of the present disclosure will be described with reference to FIGS. 1 to 7.

During a data period X where the data voltage Vdata is supplied to the data line DL, the gate driver 200 may supply a gate of the first transistor Tsw1 with a gate pulse GP which turns on the first transistor Tsw1, and then, may supply a gate-off signal Goff which turns off the first transistor Tsw1.

That is, during the data period X where the first switching unit 510 of the switching driver 500 is turned on and thus the data voltage Vdata is supplied to the data line DL, the gate driver 200 may supply the gate of the first transistor Tsw1 with the gate pulse GP which turns on the first transistor Tsw1, and then, may supply the gate-off signal Goff which turns off the first transistor Tsw1.

To this end, signals shown in FIG. 7 may be supplied to the switching driver 500 and the pixel driving unit PDU included in the pixel 101.

First, the data driver 300 may generate and output the data voltage Vdata from before an initialization period A starts. The data driver 300 may output the data voltage Vdata during a one-horizontal period 1H.

Before the initialization period A starts, a first control signal DMUX1, a gate signal VG, and a sensing control signal VS may have a high level, and an emission signal EM may have a low level.

Therefore, before the initialization period A starts, the first switching unit 510, the first transistor Tsw1, the second transistor Tsw2, and the fifth transistor Tsw5 may be turned off, and the third transistor Tsw3 and the fourth transistor Tsw4 may be turned on.

In this case, a second control signal DMUX2 having a low level may be supplied to the second switching unit 510*a* connected to the other pixel 101*a*.

Before the initialization period A starts, the data driver 300 may output the data voltage Vdata to the connection line CL1. However, because the first switching unit 510 is turned off, the data voltage Vdata may not be supplied to the data line DL.

Subsequently, when a first setting period T1 elapses after the initialization period A starts, the first switching unit 510 may be turned on. To this end, the first control signal DMUX1 having a low level may be supplied to the first switching unit 510, and thus, the first switching unit 510 may be turned on. The first setting period T1 may be included in the initialization period A.

As the first switching unit 510 is turned on, the data voltage Vdata supplied from the data driver 300 to the connection line CL1 may be supplied to the data line DL through the first switching unit 510.

However, in the initialization period A, as the gate-off signal Goff having a high level is supplied to the first transistor Tsw1, the first transistor Tsw1 may be still turned off. Accordingly, the data voltage Vdata supplied to the data line DL may not be transferred through the first transistor Tsw1.

When the initialization period A starts, the sensing control signal VS having a low level may be supplied to the sensing control line SCL, and the emission signal EM having a low level may be supplied to the emission line EL. Therefore, as described above with reference to FIG. 6A, the reference voltage Vref supplied through the second transistor Tsw2, the third transistor Tsw3, the fourth transistor Tsw4, and the fifth transistor Tsw5 may initialize the first terminal and the second terminal of the capacitor Cst.

Subsequently, in a sampling period B, the first switching unit 510 may be maintained in a turn-on state. Therefore, the first control signal DMUX1 having a low level may be continuously supplied to the first switching unit 510. Accordingly, the data voltage Vdata may be continuously supplied to the data line DL through the first switching unit 510.

When a second setting period T2 elapses after the sampling period B starts, the first transistor Tsw1 may be turned on, and then, may be again turned off before the sampling period B ends.

Therefore, a gate pulse period where the gate pulse GP for turning on the first transistor Tsw1 is supplied to the gate of the first transistor Tsw1 may be included in the data period X where the first switching unit 510 is turned on.

That is, in the present disclosure, the first transistor Tsw1 may be turned on while the first switching unit 510 is turned on and the data voltage Vdata is being supplied to the data line, and thus, the data voltage Vdata may be applied to the first node N1.

In this case, while the data voltage Vdata is being supplied to the data line DL, the first transistor Tsw1 may be turned on, and thus, a coupling effect based on the first transistor Tsw1 may be reduced. Accordingly, the data voltage Vdata supplied to the data line DL may pass through the first transistor Tsw1 and may be transferred to the first node N1.

To provide an additional description, after the data voltage Vdata is supplied to the data line DL through the first switching unit 510, the first switching unit 510 may be turned off, and then, when the first transistor Tsw1 is turned on, coupling between the turned-on first transistor Tsw1 and the data voltage Vdata may occur, whereby the data voltage Vdata passing through the first transistor Tsw1 may vary. Therefore, the data voltage Vdata supplied to the data line DL may differ from the data voltage Vdata charged into the first node N1. Due to such a phenomenon, a defect such as a widthwise belt may occur in a widthwise direction of the light emitting display panel 100, and a color sense difference caused by a variation of the data voltage Vdata may occur.

However, according to the present disclosure, while the first switching unit 510 is turned on and the data voltage Vdata is being supplied to the data line DL, the first transistor Tsw1 may be turned on, and thus, a coupling effect based on the first transistor Tsw1 may be reduced. Accordingly, the data voltage Vdata supplied to the data line DL may pass through the first transistor Tsw1 and may be transferred to the first node N1.

In the sampling period B, a sensing control signal VS having a low level may be supplied to the sensing control line SCL and an emission signal EM having a high level may be supplied to the emission line EL, and thus, the second transistor Tsw2 and the fifth transistor Tsw5 connected to the sensing control line SCL may be turned on and the third transistor Tsw3 and the fourth transistor Tsw4 connected to the emission line EL may be turned off.

Therefore, in the sampling period B as described above with reference to FIG. 6B, the first node voltage may be the data voltage Vdata, and the gate voltage of the driving transistor Tdr may be the difference voltage (=VDD−|Vth|) between the absolute value of the threshold voltage Vth of the driving transistor Tdr and the first voltage VDD applied through the driving transistor Tdr.

The first transistor Tsw1 may be again turned off before the sampling period B ends. Therefore, a data voltage may not be supplied to the first node N1 any longer.

Subsequently, when a third setting period T3 elapses after a hold period C starts, the first switching unit 510 may be turned off, and thus, the data voltage Vdata may not be supplied to the data line DL any longer. To this end, when the third setting period T3 elapses after the hold period C starts, a first control signal DMUX1 having a high level for turning off the first switching unit 510 may be supplied to the first switching unit 510.

In this case, the data driver 300 may output the data voltage Vdata to the connection line CL1 until before the first switching unit 510 is turned off in the hold period C from before the initialization period A starts.

That is, the data driver 300 may output a data voltage to the connection line CL1 until before the first switching unit 510 is turned off in the hold period C after the first transistor Tsw1 is turned off in the sampling period B.

Therefore, the data voltage Vdata may be sufficiently charged into the data line DL.

For example, in a one-horizontal period 1H where the data driver 300 outputs the data voltage Vdata to the connection line CL1, when the first transistor Tsw1 is turned off, a data voltage may not be supplied to the first node N1, and thus, the data voltage Vdata may not be supplied to the data line DL. Therefore, the first switching unit 510 may be turned off. In the following description, a first horizontal period may denote a period where the data voltage Vdata is output to the data line DL, namely, an order of the one-horizontal period 1H. For example, the data driver 300 may output the data voltage Vdata in the first horizontal period, and the data driver 300 may output the data voltage Vdata in a second horizontal period. A data voltage which is output in the first horizontal period may be the same as or differ from a data voltage which is output in the second horizontal period.

In this case, when the first transistor Tsw1 is turned off, or when the first switching unit 510 is turned off immediately after the first transistor Tsw1 is turned off, the data voltage Vdata may be sufficiently charged into the data line DL. In this case, when a difference between a data voltage Vdata supplied to the data line DL in the second horizontal period and a data voltage Vdata supplied to the data line DL in the first horizontal period is large, a period where the data voltage Vdata is charged into the data line DL in the second horizontal period may be delayed.

For example, when a data voltage output to the data line DL in the first horizontal period is 1 V corresponding to a low gray level and the first transistor Tsw1 is turned off, or when the first switching unit 510 is turned off immediately after the first transistor Tsw1 is turned off, an electric charge corresponding to 1 V (volt) may not sufficiently be charged into the data line DL. For example, after the first switching unit 510 is turned off, only 0.8 V may be charged into the data line DL.

However, as in the present disclosure, when a data voltage is supplied to the data line DL through the connection line CL1 until before the first switching unit 510 is turned off in the hold period C after the first transistor Tsw1 is turned off in the sampling period B, an electric charge corresponding to 1 V may be sufficiently charged into the data line DL. For example, after the first switching unit 510 is turned off, 1 V may be charged into the data line DL.

In this case, when a data voltage supplied to the data line DL in the second horizontal period is 10 V corresponding to a high gray level, a period where a voltage charged into the data line DL increases from 1 V to 10V may be shorter than a period where a voltage charged into the data line DL increases from 0.8 V to 10V.

Therefore, according to the present disclosure, a variation of the data voltage Vdata in the data line DL may be quickly performed without delay. Accordingly, the image quality of the light emitting display apparatus may be enhanced.

That is, in the present disclosure, a data voltage may be supplied to the data line DL through the connection line CL1 until before the first switching unit 510 is turned off in the hold period C after the first transistor Tsw1 is turned off in the sampling period B, a data voltage may be supplied to the data line DL through the connection line CL1, and thus, the data voltage Vdata may be sufficiently charged into the data line DL, whereby a delay time may not occur when the data voltage Vdata is charged into the data line DL. Accordingly, the image quality of the light emitting display apparatus may be enhanced.

In the hold period C, the sensing control signal VS having a high level may be supplied to the sensing control line VSL, the emission signal EM having a high level may be supplied to the emission line EL, and the gate signal VG (i.e., the gate-off signal Goff) having a high level may be supplied to the gate line GL. Accordingly, all of the first to fifth transistors Tsw1 to Tsw5 may be turned off.

In this case, as described above with reference to FIG. 6C, in the hold period C, a first node voltage and a gate voltage of a driving transistor may be maintained as a first node voltage and a gate voltage of a driving transistor in the sampling period B.

Finally, in the emission period D, as described above and illustrated in FIG. 7, the first control signal DMUX1, the sensing control signal VS, and the gate signal VG may have a high level, and the emission signal EM may have a low level.

Therefore, the driving transistor Tdr and the third and fourth transistors Tsw3 and Tsw4 to which the emission signal EM is supplied may be turned on, and the first transistor Tsw1, the second transistor Tsw2, and the fifth transistor Tsw5 may be turned off.

That is, the third transistor Tsw3 and the fourth transistor Tsw4 may be turned off up to the hold period C from the sampling period B and may be turned on in the emission period D.

Therefore, a current I supplied to the driving transistor Tdr and the fourth transistor Tsw4 may be supplied to the light emitting device ED, and thus, the light emitting device ED may emit light.

In this case, as expressed in Equation 1, a level of the current I supplied to the light emitting device ED may be proportional to the square of the data voltage Vdata and the reference voltage Vref. Accordingly, the current I supplied to the light emitting device ED may vary based on only the data voltage Vdata supplied through the data line DL and the reference voltage Vref supplied through the sensing line SL and may not vary based on the threshold voltage Vth of the driving transistor Tdr.

Therefore, even when the threshold voltage of the driving transistor Tdr varies due to a degradation in the driving transistor Tdr, the luminance of light emitted from the light emitting device ED may vary based on only the data voltage Vdata. Accordingly, the light emitting display apparatus according to the present disclosure may continuously and stably operate.

According to the aspects of the present disclosure, when a data voltage is supplied from a data driver to a data line, a first transistor included in the pixel driving unit and connected to the data line may be turned on. Accordingly, even when a compensation operation for preventing or at least reducing a degradation in a driving transistor included in the pixel driving unit is performed while an image is being displayed, a data voltage supplied to the pixel driving unit through the data line may not be shifted by coupling.

That is, according to the present disclosure, a phenomenon where a data voltage is shifted through coupling to a turned-on transistor may be prevented.

Therefore, a defect such as a widthwise belt that may occur in a widthwise direction of a light emitting display panel, and a color sense difference may decrease in an image displayed by the light emitting display panel.

The above-described feature, structure, and effect of the present disclosure are included in at least one aspect of the present disclosure, but are not limited to only one aspect. Furthermore, the feature, structure, and effect described in at least one aspect of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A light emitting display apparatus comprising:

a light emitting display panel including a pixel, the pixel comprising a first transistor connected to a gate line and a data line;

a gate driver supplying a gate signal to the first transistor;

a data driver supplying a data voltage to the data line; and a switching driver connecting the data line to the data driver or connecting a sensing line to the data driver, the sensing line included in the pixel, wherein the gate driver turns on and then turns off the first transistor during a data period where the data voltage is supplied from the data driver to the data line through the switching driver, wherein the pixel comprises:

a light emitting device;

the first transistor including a first terminal connected to the data line and a gate connected to the gate line to which the gate signal is supplied;

a driving transistor including a first terminal connected to a first voltage supply line;

a capacitor connected between a second terminal of the first transistor and a gate of the driving transistor;

a second transistor including a first terminal connected to the gate of the driving transistor, a second terminal connected to a second terminal of the driving transistor, and a gate connected to a sensing control line;

a third transistor including a first terminal connected to the second terminal of the first transistor, a second terminal connected to the sensing line, and a gate connected to an emission line;

a fourth transistor including a first terminal connected to the second terminal of the driving transistor, a second terminal connected to a first terminal of the light emitting device, and a gate connected to the emission line; and a fifth transistor including a first terminal connected to the first terminal of the light emitting device, a gate connected to the sensing control line, and a second terminal connected to the sensing line, wherein during the data period, the gate driver supplies the gate of the first transistor with a gate pulse for turning on the first transistor, and then, supplies the gate of the first transistor with a gate-off signal for turning off the first transistor.

2. The light emitting display apparatus of claim 1, wherein the switching driver comprises:

a first switching unit connecting the data line to the data driver; and a multiplexor switching unit connecting the sensing line to the data driver.

3. The light emitting display apparatus of claim 2, wherein during the data period where the first switching unit is turned on and the data voltage is supplied to the data line, the gate driver supplies the gate of the first transistor with the gate pulse for turning on the first transistor, and then, supplies the gate of the first transistor with the gate-off signal for turning off the first transistor.

4. The light emitting display apparatus of claim 3, wherein a gate pulse period, where the gate pulse for turning on the first transistor is supplied to the gate of the first transistor, is included in the data period where the first switching unit is turned on.

5. The light emitting display apparatus of claim 3, wherein, in an initialization period, the first terminal and the second terminal of the capacitor are initialized by a reference voltage supplied through the sensing line, in a sampling period, the first transistor is turned on, and accordingly, a voltage at the first terminal of the capacitor connected to the first transistor is the data voltage and a voltage at the second terminal of the capacitor connected to the gate of the driving transistor is a difference voltage between a first voltage supplied through the driving transistor and an absolute value of a threshold voltage of the driving transistor, in a hold period, a voltage at the first terminal of the capacitor and a voltage at the second terminal of the capacitor are maintained as the data voltage and the difference voltage, and in an emission period, a difference voltage between the gate and a source of the driving transistor is a difference voltage between the data voltage and the reference voltage.

6. The light emitting display apparatus of claim 5, wherein, when a first setting period elapses after the initialization period starts, the first switching unit is turned on, in the sampling period, the first switching unit is maintained in a turned-on state, when a second setting period elapses after the sampling period starts, the first transistor is turned on, the first transistor is turned off before the sampling period ends, and when a third setting period elapses after the hold period starts, the first switching unit is turned off.

7. The light emitting display apparatus of claim 6, wherein the data driver outputs the data voltage from before the initialization period stars until the first switching unit is turned off in the hold period.

8. The light emitting display apparatus of claim 7, wherein the data driver outputs the data voltage after the first transistor is turned off until the first switching unit is turned off.

9. The light emitting display apparatus of claim 6, wherein the third transistor and the fourth transistor are turned off up to the hold period from the sampling period and is turned on in the emission period.

10. The light emitting display apparatus of claim 1, wherein the data driver comprises:

a data voltage generator generating the data voltage which is to be transferred to the data line;

a reference voltage transferor transferring a reference voltage to the sensing line;

a converter converting a sensing signal, transferred through the sensing line, into sensing data and transferring the sensing data to a controller; and a switching unit connecting the switching driver to one of the data voltage generator, the reference voltage transferor, and the converter.

11. The light emitting display apparatus of claim 1, wherein a gate pulse period where the gate pulse for turning on the first transistor is supplied to the gate of the first transistor is included in the data period where the data voltage is supplied to the data line through the switching driver.

12. The light emitting display apparatus of claim 1, wherein the sensing line is connected to a transistor which includes a first terminal connected to a light emitting device and a second terminal connected to the sensing line.

* * * * *